US010337353B2

(12) United States Patent
Anga et al.

(10) Patent No.: US 10,337,353 B2
(45) Date of Patent: Jul. 2, 2019

(54) CASING RING ASSEMBLY WITH FLOWPATH CONDUCTION CUT

(71) Applicant: General Electric Company, Schenectady, NY (US)

(72) Inventors: Prathap Anga, Bangalore (IN); Howard R. Spofford, West Chester, OH (US); Kenneth Edward Seitzer, Cincinnati, OH (US); Thomas Compton, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 511 days.

(21) Appl. No.: 14/587,836

(22) Filed: Dec. 31, 2014

(65) Prior Publication Data

US 2016/0186612 A1 Jun. 30, 2016

(51) Int. Cl.

| | |
|---|---|
| ***F01D 25/00*** | (2006.01) |
| ***F01D 25/24*** | (2006.01) |
| ***F01D 25/26*** | (2006.01) |
| ***F01D 25/28*** | (2006.01) |

(52) U.S. Cl.

CPC ..... *F01D 25/26* (2013.01); *F01D 25/005* (2013.01); *F01D 25/243* (2013.01); *F01D 25/28* (2013.01); *F05D 2220/32* (2013.01); *F05D 2240/90* (2013.01); *F05D 2300/6033* (2013.01)

(58) Field of Classification Search

CPC ..... F01D 11/025; F01D 11/08; F01D 11/14; F01D 25/26; F01D 25/265; F01D 25/243; F01D 25/005; F01D 25/28

See application file for complete search history.

(56) References Cited

U.S. PATENT DOCUMENTS

| | | | | |
|---|---|---|---|---|
| 2,710,523 | A * | 6/1955 | Purvis | F01D 25/30 415/119 |
| 2,716,563 | A | 8/1955 | Seneschall | |
| 2,809,057 | A | 10/1957 | McEachern | |
| 4,268,221 | A | 5/1981 | Monsarrat et al. | |
| 4,329,114 | A | 5/1982 | Johnston et al. | |
| 4,522,559 | A * | 6/1985 | Burge | F01D 25/26 415/138 |
| 4,639,388 | A * | 1/1987 | Ainsworth | B32B 15/04 228/120 |
| 4,683,716 | A | 8/1987 | Wright et al. | |

(Continued)

FOREIGN PATENT DOCUMENTS

| | | |
|---|---|---|
| EP | 0657624 A1 | 6/1995 |
| EP | 2495402 A2 | 9/2012 |

(Continued)

OTHER PUBLICATIONS

Power, D. C., "Palladium Alloy Pinning Wires for Gas Turbine Blade Investment Casting", Platinum Metal Rev, 1995, vol. 39, (3), 117-126.*

(Continued)

*Primary Examiner* — Ninh H. Nguyen
*Assistant Examiner* — Brian P Wolcott
(74) *Attorney, Agent, or Firm* — Dority & Manning, P.A.

(57) ABSTRACT

A casing assembly for a gas turbine engine having a centerline axis, the casing apparatus includes: a metallic inner ring defining an annular flowpath surface; a metallic outer ring positioned in axial alignment with and radially outward of the inner ring; and a conduction cut structure disposed between the inner and outer rings.

15 Claims, 5 Drawing Sheets

(56) References Cited

U.S. PATENT DOCUMENTS

| | | | | |
|---|---|---|---|---|
| 5,092,737 | A | 3/1992 | Lau | |
| 5,154,575 | A | 10/1992 | Bonner | |
| 5,927,942 | A | 7/1999 | Stahl et al. | |
| 6,896,483 | B2 * | 5/2005 | Dierksmeier | F01D 11/18 403/28 |
| 7,094,029 | B2 | 8/2006 | Taylor et al. | |
| 8,079,807 | B2 * | 12/2011 | Shapiro | F01D 11/12 415/173.1 |
| 2008/0006384 | A1 * | 1/2008 | Memmen | B22C 7/02 164/45 |

FOREIGN PATENT DOCUMENTS

| | | | | |
|---|---|---|---|---|
| EP | 2540994 | A1 | 1/2013 | |
| JP | 09504588 | A | 5/1997 | |
| JP | 2006026742 | A | 2/2006 | |
| JP | 2007218119 | A | 8/2007 | |
| WO | 2014200768 | A1 | 12/2014 | |
| WO | WO 2014200768 | A1 * | 12/2014 | F01D 11/025 |

OTHER PUBLICATIONS

Unofficial English Translation of Japanese Office Action issued in connection with corresponding JP Application No. 2015244699 dated Nov. 1, 2016.

D.C.Power, Palladium Alloy Pinning Wires for Gas Turbine Blade Investment Casting, Platinum Metals Rev., 1995, 39, (3) pp. 117-126.

European Search Report and Opinion issued in connection with corresponding EP Application No. 15200660.7 dated Jul. 21,2016.

* cited by examiner

FIG. 9
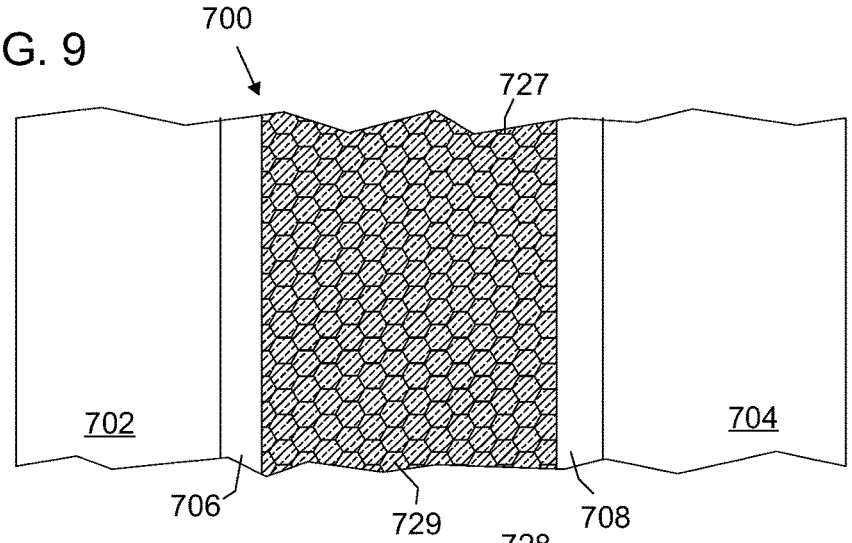
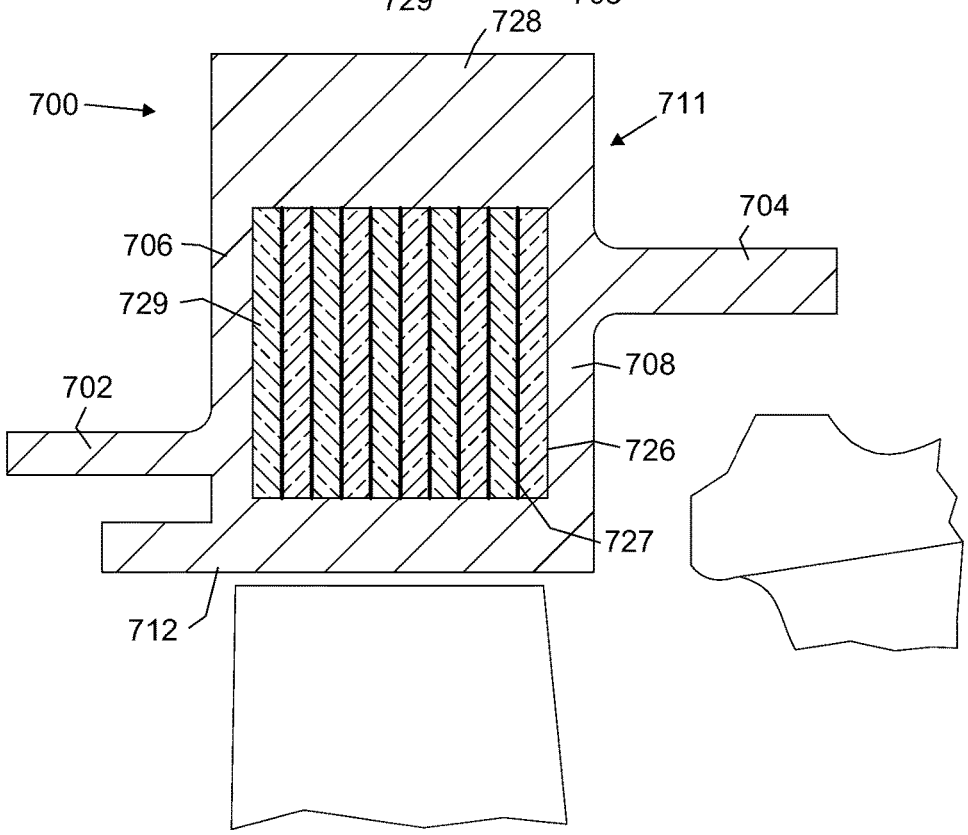
FIG. 8

CASING RING ASSEMBLY WITH FLOWPATH CONDUCTION CUT

BACKGROUND OF THE INVENTION

This invention relates generally to compressors in gas turbine engines and more particularly to casings of such compressors.

A gas turbine engine includes a compressor, a combustor, and at least one turbine in a serial axial-flow relationship. The compressor includes a rotor assembly and a stator assembly. The rotor assembly includes one or more rows of rotor blades arrayed around a shaft. The stator assembly includes one or more rows of stator vanes which are disposed between adjacent rows of rotor blades to direct air flow passing there through to downstream rotor blades. A casing assembly provides structural support for the stator vanes and defines the outer boundary of the flowpath through the rotor blades. Maintaining appropriate clearances between tips of the rotor blades and the surrounding casing is important for maximizing the operating efficiency of the compressor. However, the compressor is subject to elevated and varying temperatures during operation. Therefore, it is common for high pressure compressor, especially the casings in the aft portions of the compressor, to experience challenges in maintaining desired radial clearances between the casing and the rotor, because of mismatch between rotor and stator thermal responses (time constants).

Accordingly, there remains a need for a compressor having a casing with thermal growth characteristics well-matched to the rotor thermal growth characteristics.

BRIEF SUMMARY OF THE INVENTION

This need is addressed by the present invention, which provides a casing having a heat flowpath conduction cut between inner and outer rings of a casing.

According to one aspect of the invention, a casing assembly is provided for a gas turbine engine having a centerline axis, the casing apparatus includes: a metallic inner ring defining an annular flowpath surface; a metallic outer ring positioned in axial alignment with and radially outward of the inner ring; and a conduction cut structure disposed between the inner and outer rings.

According to another aspect of the invention, the conduction cut is defined by a cavity disposed between the inner and outer rings.

According to another aspect of the invention, a vent is provided, connecting the cavity with the surrounding environment.

According to another aspect of the invention, the cavity is filled with a cellular material.

According to another aspect of the invention, cells of the cellular material are filled with a ceramic material having a thermal conductivity lower than a thermal conductivity of the inner ring.

According to another aspect of the invention, the cellular material comprises a honeycomb having hexagonal cells defined by metallic walls.

According to another aspect of the invention, the cavity is filled with a ceramic material having a thermal conductivity lower than a thermal conductivity of the inner ring.

According to another aspect of the invention, the outer ring is formed by first and second rings each having a radially-aligned flange, wherein the flanges abut each other and are clamped together by a mechanical fastener; and the inner ring is coupled to one of the rings by an annular arm extending from a first end of the inner ring.

According to another aspect of the invention, the inner ring includes a seal flange extending from a second end thereof towards the outer ring.

According to another aspect of the invention, a resilient seal is disposed between the seal flange and the outer ring.

According to another aspect of the invention, the resilient seal is disposed in a rabbet formed in the seal flange.

According to another aspect of the invention, the outer ring is formed by: first and second rings each having a radially-oriented flange, wherein the flanges are axially spaced-apart from each other; and an outboard ring interconnecting radially outer ends of the flanges; and the inner ring interconnects radially inner ends of the flanges, such that the flanges of the first and second rings, the outboard ring, and the inner ring collectively define a cavity.

According to another aspect of the invention, the outboard ring is thermally bonded to the flanges.

According to another aspect of the invention, the cavity is filled with a ceramic material having a thermal conductivity lower than a thermal conductivity of the inner ring.

According to another aspect of the invention, the outer ring and the inner ring are formed as a monolithic whole.

According to another aspect of the invention, a method of making a casing assembly includes: providing a mold comprising a ceramic material with a mold cavity therein, defining the casing assembly above; suspending a block of ceramic material within the mold cavity; filling the mold with molten metal alloy; allowing the metal alloy to solidify; and removing the mold, leaving the block within the solidified metal alloy.

According to another aspect of the invention, the block is suspended by wires embedded in the block and the mold.

According to another aspect of the invention, a compressor for a gas turbine engine includes: a rotor comprising a plurality of circumferentially-spaced apart rotor blades, and a casing apparatus positioned surrounding the rotor, including: a metallic inner ring defining an annular flowpath surface; a metallic outer ring positioned in axial alignment with and radially outward of the inner ring; and a conduction cut structure disposed between the inner and outer rings.

According to another aspect of the invention, the conduction cut is defined by a cavity disposed between the inner and outer rings.

According to another aspect of the invention, the cavity is filled with a cellular material.

BRIEF DESCRIPTION OF THE DRAWINGS

The invention may be best understood by reference to the following description taken in conjunction with the accompanying drawing figures in which:

FIG. 8 is half-sectional view of a portion of an alternative compressor casing assembly constructed according to an aspect of the present invention; and FIG. 9 is a partial sectional view taken along lines 9-9 of FIG. 8.

DETAILED DESCRIPTION OF THE INVENTION

In general, the present invention provides a compressor casing assembly having inner and outer rings. A structure acting as a conduction cut is disposed between the outer and inner casing. As used herein, the term "conduction cut" describes a break or a step-change reduction in the thermal conductivity in the physical path for conduction heat transfer between the inner and outer rings, having the effects of (1) reducing the temperature of the outer ring and (2) slowing down the casing assembly's thermal response, for the purpose of improving the match of the casing assembly's thermal response with a rotor's thermal response.

The functional principles of a conduction cut in a casing may be implemented using various physical configurations, several examples of which are described below.

It is noted that, as used herein, the term "axial" or "longitudinal" refers to a direction parallel to an axis of rotation of a gas turbine engine, while "radial" refers to a direction perpendicular to the axial direction, and "tangential" or "circumferential" refers to a direction mutually perpendicular to the axial and tangential directions. As used herein, the terms "forward" or "front" refer to a location relatively upstream in an air flow passing through or around a component, and the terms "aft" or "rear" refer to a location relatively downstream in an air flow passing through or around a component. The direction of this flow is shown by the arrow "F" in FIG. 1. These directional terms are used merely for convenience in description and do not require a particular orientation of the structures described thereby.

Figure 1:
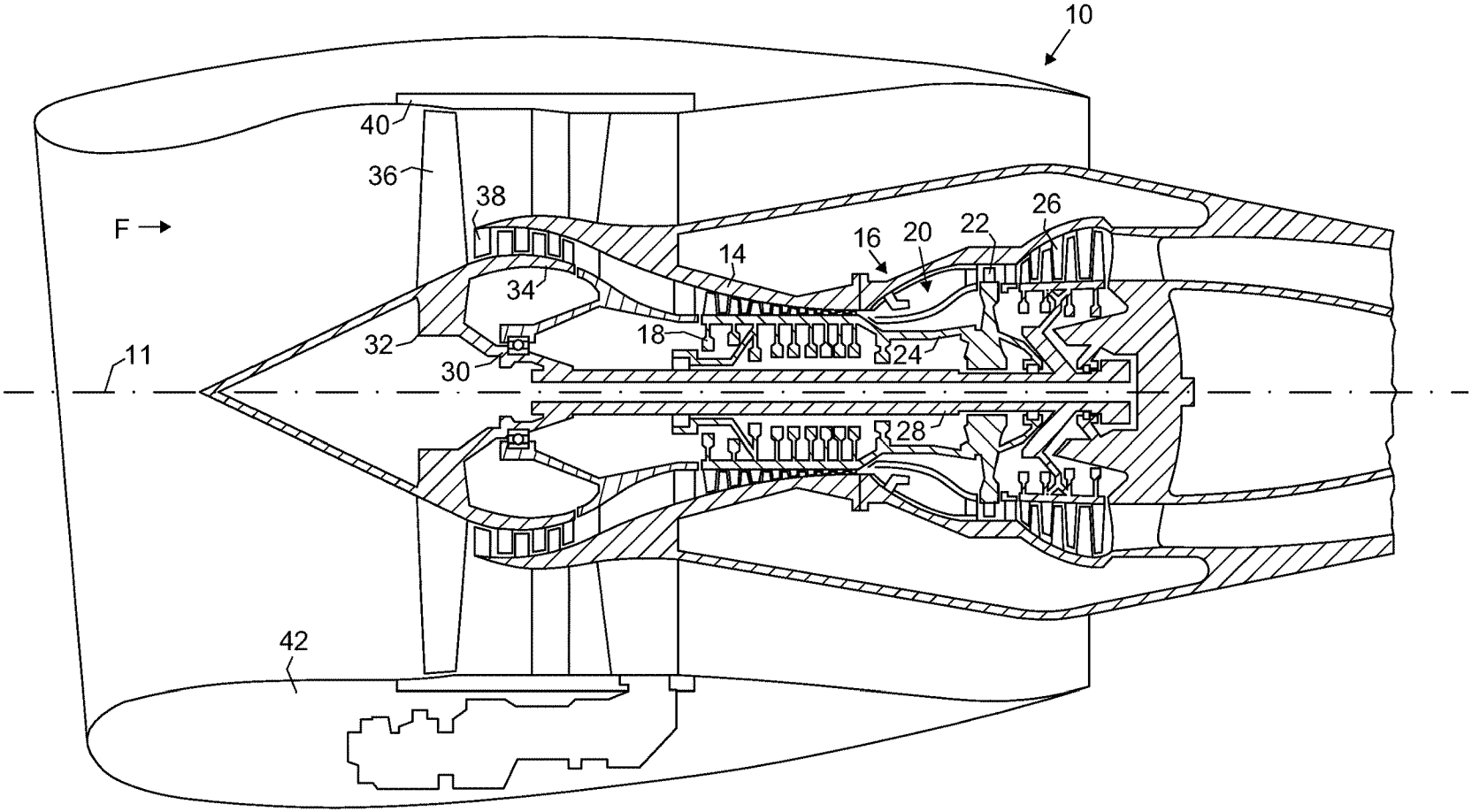
FIG. 1 is a sectional, schematic view of a gas turbine engine incorporating a compressor casing.

Now, referring to the drawings wherein identical reference numerals denote the same elements throughout the various views, FIG. 1 illustrates a gas turbine engine, generally designated 10. The engine 10 has a longitudinal centerline axis 11 and an outer stationary annular casing 14 disposed coaxially along the axis 11. The engine 10 includes a gas generator core 16 which is composed of a multi-stage compressor 18, a combustor 20, and a high pressure turbine 22, either single or multiple stages, all arranged coaxially about the centerline axis 11 in a serial, axial flow relationship. An annular outer drive shaft 24 interconnects the compressor 18 and high pressure turbine 22.

In operation, pressurized air from the compressor 18 is mixed with fuel in the combustor 20 and ignited, thereby generating combustion gases. Some work is extracted from these gases by the high pressure turbine 22 which drives the compressor 18. The remainders of the combustion gases are discharged from the core 16 into a low pressure turbine 26.

An inner drive shaft 28 is mounted for rotation relative to the outer drive shaft 24. The inner drive shaft 28 is driven by the low pressure turbine 26 and drives a forward fan shaft 30, which in turn drives a forward fan rotor 32 and, in some cases, a booster rotor 34. Fan blades 36 and booster blades 38 are mounted to the fan rotor 32 and booster rotor 34, respectively, for rotation therewith. The fan blades 36 are surrounded by an annular fan casing 40 which is in turn surrounded by an annular fan nacelle 42.

Figure 2:
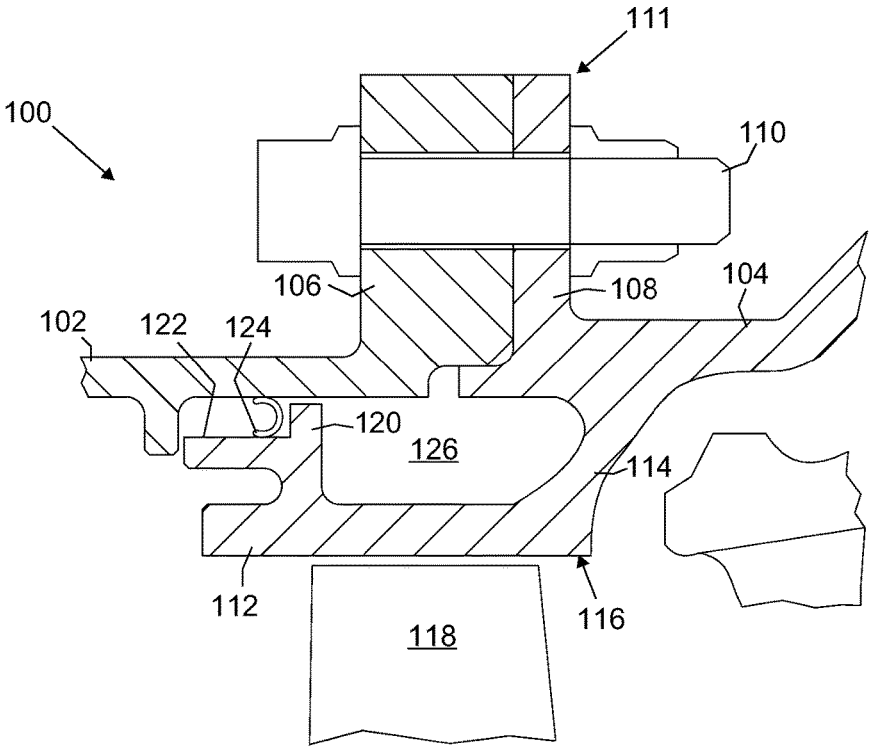
FIG. 2 is half-sectional view of a portion of a compressor casing assembly constructed according to an aspect of the present invention.

FIG. 2 is a cross-sectional illustration of a portion of a casing assembly 100 that may be incorporated into the engine 10, specifically in the portion of the casing 14 surrounding the compressor 18. The casing assembly 100 includes a forward ring 102 and an aft ring 104. The forward ring 102 is annular and includes a forward flange 106 extending radially outward therefrom. The aft ring 104 is annular and includes an aft flange 108 extending radially outward therefrom. Both rings are metallic. Non-limiting examples of known aerospace alloys suitable for the rings include steel, titanium, nickel, and cobalt-based alloys, such as INCONEL, MAR-M-509, WASPALOY, and L605. The forward and aft flanges 106 and 108 abut each other and are clamped together by a plurality of mechanical fasteners 110 extending through mating holes in the forward and aft flanges 106, 108. A nut and bolt combination is shown, but other types of mechanical fasteners are known. When clamped together, the forward and aft rings 102 and 104 and their corresponding flanges 106 and 108 collectively define an annular structure referred to herein as an "outer ring" 111.

An inner ring 112 is disposed radially inward from the aft ring 104. The aft end of the inner ring 112 is coupled to the aft ring 104 by an annular arm 114. The inner ring 112 incorporates an annular flowpath surface 116 which closely surrounds the outer end of a row of rotatable compressor blades 118. The forward end of the inner ring 112 includes a seal flange 120 extending radially outward and terminating a small distance away from the forward ring 102. The seal flange 120 in turn includes an annular rabbet 122. The aft ring 104, arm 114, inner ring 112, and seal flange 120 may all be part of a single integral, unitary, or monolithic structure. The rabbet 122 receives an annular seal 124. The purpose of the seal 124 is to prevent leakage between the inner ring 112 and the outer ring 111. In the illustrated example the seal is a resilient metallic device and has a C-shaped cross-section.

Collectively, the inner ring 112, the forward ring 102, and the aft ring 104 define an open cavity 126 disposed in axial alignment with the inner ring 112 and radially outward thereof. The presence of the cavity 126 serves as a conduction cut mentioned above, by interposing a volume of air between the inner and outer rings 112, 111. It is noted that air has a thermal conductivity (denoted "k") about ⅓ of that of the metal alloys from which the casing assembly 100 is made.

Figure 3:
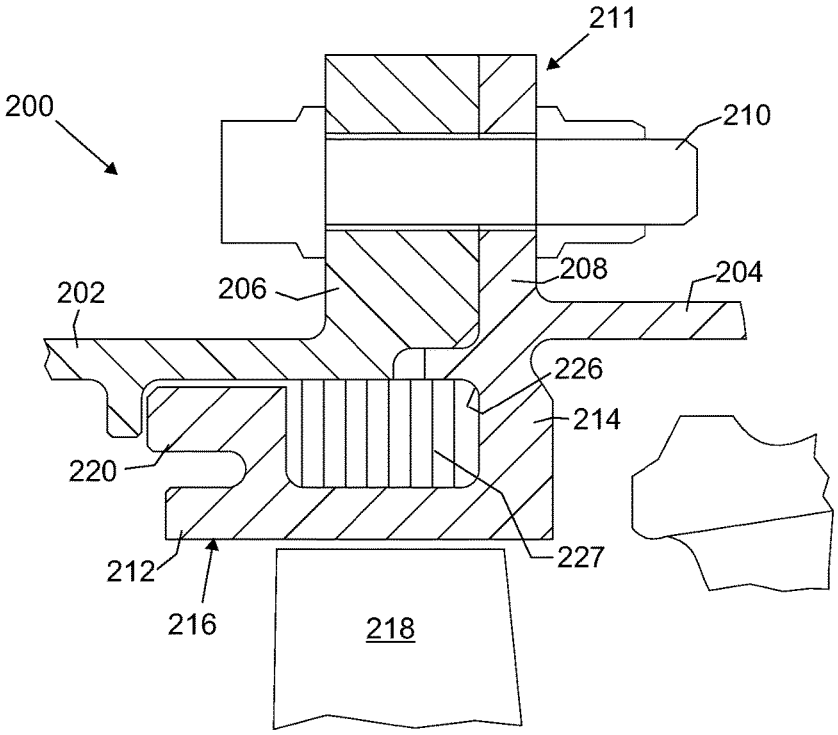
FIG. 3 is half-sectional view of a portion of an alternative compressor casing assembly constructed according to an aspect of the present invention.

FIG. 3 illustrates a portion of an alternative casing assembly 200 which is similar to the casing assembly 100 described above. Elements of the casing assembly 200 not explicitly described may be considered identical to the corresponding elements of the casing assembly 100. The casing assembly 200 includes a forward ring 202 with a forward flange 206 and an aft ring 204 with an aft flange 208. The forward and aft flanges 206 and 208 abut each other and are clamped together by a plurality of mechanical fasteners 210 extending through mating holes in the forward and aft flanges 206, 208. When clamped together, the forward and aft rings 202 and 204 collectively define an annular structure referred to herein as an "outer ring" 211.

An inner ring 212 is disposed radially inward from the aft ring 204. The aft end of the inner ring 212 is coupled to the aft ring 204 by an annular arm 214. The inner ring 212 incorporates an annular flowpath surface 216 which closely surrounds the outer end of a row of rotatable compressor blades 218. The forward end of the inner ring 212 includes a flange 220 extending radially outward towards the forward ring 202. The aft ring 204, arm 214, inner ring 212, and flange 220 may all be part of a single integral, unitary, or monolithic structure.

Collectively, the inner ring 212, the forward ring 202, and the aft ring 204 define a cavity 226 disposed in axial alignment with, and radially outboard of, the inner ring 212. A ring of cellular material 227 is disposed inside the cavity 226. "Cellular material" in used herein to refer to any material comprising a two-dimensional array of side-by-side cells, whether the cells be hexagonal (as in a honeycomb) or some other cellular shape such as circular, rectangular, etc. Various honeycomb materials are known in which the cells are formed by joined walls of thin sheet metal. The cells may be oriented with their long axis parallel to the radial direction, as shown in FIG. 3. The presence of the cellular material 227 serves as a conduction cut mentioned above, as the material has a significantly lower thermal conductivity that an equivalent mass of a metal alloy.

Figure 4:
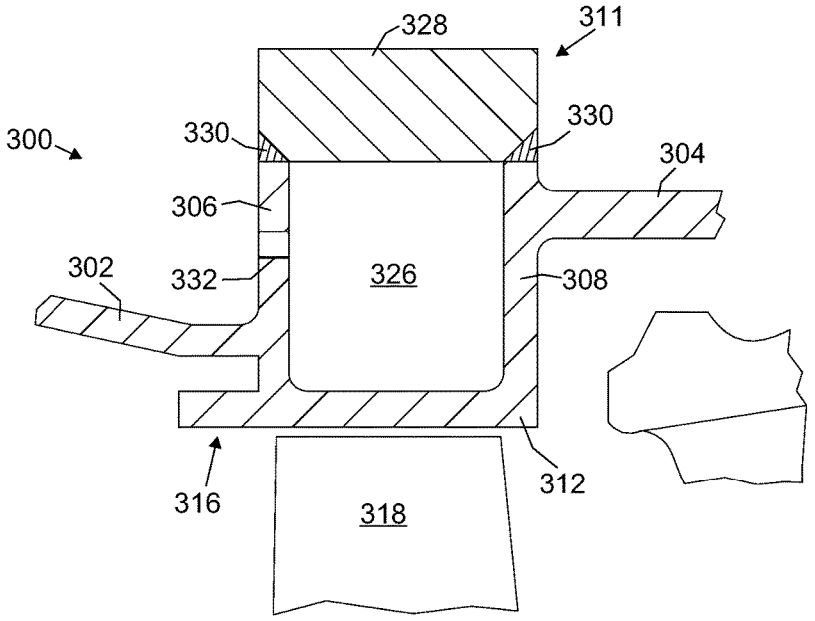
FIG. 4 is half-sectional view of a portion of an alternative compressor casing assembly constructed according to an aspect of the present invention.

FIG. 4 illustrates a portion of a casing assembly 300 including a forward ring 302 and an aft ring 304. The forward ring 302 is annular and includes a forward flange 306 extending radially outward and inward therefrom. The aft ring 304 is annular and includes an aft flange 308 extending radially outward and inward therefrom. The forward and aft flanges 306 and 308 are axially spaced apart from each other. An inner ring 312 joins the inner ends of the forward and aft flanges 306, 308. The inner ring 312 incorporates an annular flowpath surface 316 which closely surrounds the outer end of a row of rotatable compressor blades 318. The forward ring 302, forward flange 306, aft ring 304, aft flange 308, and inner ring 312 are all metallic and may all be part of a single integral, unitary, or monolithic structure.

An annular outboard ring 328 surrounds the forward and aft flanges 306 and 308 and is thermally bonded to the radially outer ends of the forward and aft flanges 306. The outboard ring 328 may be made from the same material as the forward and aft rings 302, 304 or a different material. For example, the outboard ring 328 may comprise an alloy having a lower coefficient of thermal expansion or "CTE" than the forward and aft rings 302, 304. All materials expand or contract in response to a change in temperature. The CTE relates the change in size (i.e. volume or linear dimension) of the material to the change in temperatures. Generally, CTE is expressed as $\alpha v=1/V\ (dV/dT)$ or $\alpha L=1/L\ (dL/dT)$, respectively, where $\alpha$ represents the CTE, V volume, L length, and T temperature.

Thermal bonding of the outboard ring 328 may be accomplished through methods such as brazing, welding, or diffusion bonding. In the illustrated example, the outboard ring 328 is bonded to each of the forward and aft flanges 306, 308 at welds 330 produced by the tungsten inert gas ("TIG") process.

When assembled, the forward and aft rings 302 and 304 and the outboard ring 328 collectively define an annular structure referred to herein as an "outer ring" 311.

Collectively, the inner ring 312, the forward ring 302, the aft ring 304, and the outboard ring 328 define an open cavity 326 disposed in axial alignment with the inner ring 312 and radially outward thereof. The cavity 326 may be vented to avoid excessive internal pressure. In the illustrated example, venting is provided by a small orifice 332 formed in the forward flange 306. The presence of the cavity 326 serves as a conduction cut mentioned above, by interposing a volume of air between the inner and outer rings 312, 311. The lower relative CTE of the outboard ring 328 also serves to slow down the thermal response of the outer ring 311.

Figure 5:
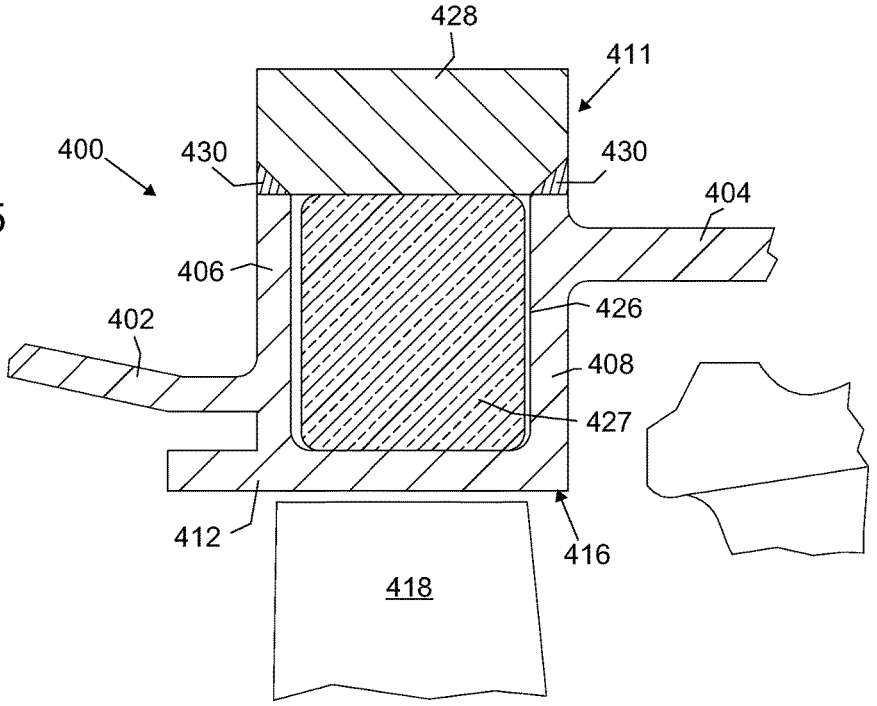
FIG. 5 is half-sectional view of a portion of an alternative compressor casing assembly constructed according to an aspect of the present invention.

FIG. 5 illustrates a casing assembly 400 similar to the casing assembly 300 shown in FIG. 4 Elements of the casing assembly 400 not explicitly described may be considered identical to the corresponding elements of the casing assembly 300. The casing assembly 400 includes a forward ring 402, with a forward flange 406, an aft ring 404 with an aft flange 408, an inner ring 412 joining the inner ends of the forward and aft flanges, and an annular outboard ring 428 surrounding the forward and aft flanges 406 and 408 and thermally bonded to the outer ends of the forward and aft flanges 406, 408, for example by welds 430. The outboard ring 428 may be made from the same material as the forward and aft rings 402, 404 or a different material with a lower CTE as described above for the outboard ring 328. When assembled, the forward and aft rings 402 and 404 and the outboard ring 428 collectively define an annular structure referred to herein as an "outer ring" 411.

Collectively, the inner ring 412, the forward ring 402, the aft ring 404, and the outboard ring 428 define a cavity 426 disposed in axial alignment with the inner ring 412 and radially outward thereof. The cavity 426 is filled with a block 427 of solid material having a thermal conductivity significantly lower than the surrounding material, such as a ceramic. Materials such as silica-, alumina-, or zircon-based ceramics commonly used for coring in the investment casting process may be used. The presence of the block 427 serves as a conduction cut mentioned above, by interposing a volume of low conductivity solid between the inner and outer rings 412, 411. It is noted that known ceramic materials can have a thermal conductivity (k) about 1/20 of that of metal alloys.

Figure 6:
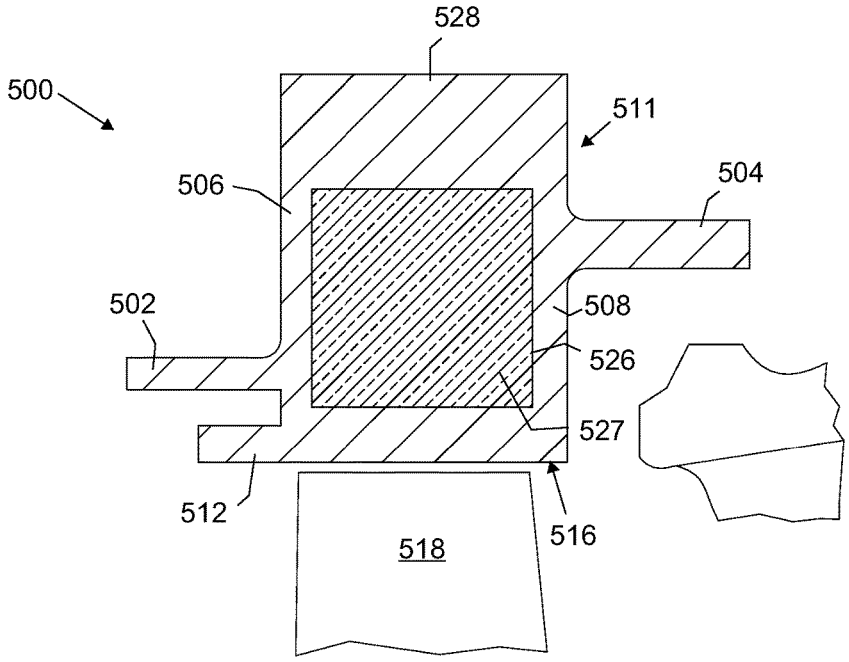
FIG. 6 is half-sectional view of a portion of an alternative compressor casing assembly constructed according to an aspect of the present invention.

FIG. 6 illustrates a casing assembly 500 similar to the casing assembly 300 shown in FIG. 4 and including a forward ring 502 with a forward flange 506, an aft ring 504 with an aft flange 508, an inner ring 512 joining the inner ends of the forward and aft flanges 506, 508, and an annular outboard ring 528 surrounding the forward and aft flanges 506 and 508. All of these elements are formed as a unitary, integral, or monolithic structure, for example using known investment casting methods. The monolithic structure, excepting the inner ring 512, constitutes an annular structure referred to herein as an "outer ring" 511.

Collectively, the inner ring 512, the forward ring 502, the aft ring 504, and the outboard ring 528 define a cavity 526 disposed in axial alignment with the inner ring 512 and radially outward thereof. The cavity 526 is filled with a block 527 of solid material having a thermal conductivity significantly lower than the surrounding material, such as a ceramic. Materials such as silica, alumina- or zircon-based ceramics commonly used for coring in the investment casting process may be used. The presence of the block 527 serves as a conduction cut mentioned above.

Figure 7:
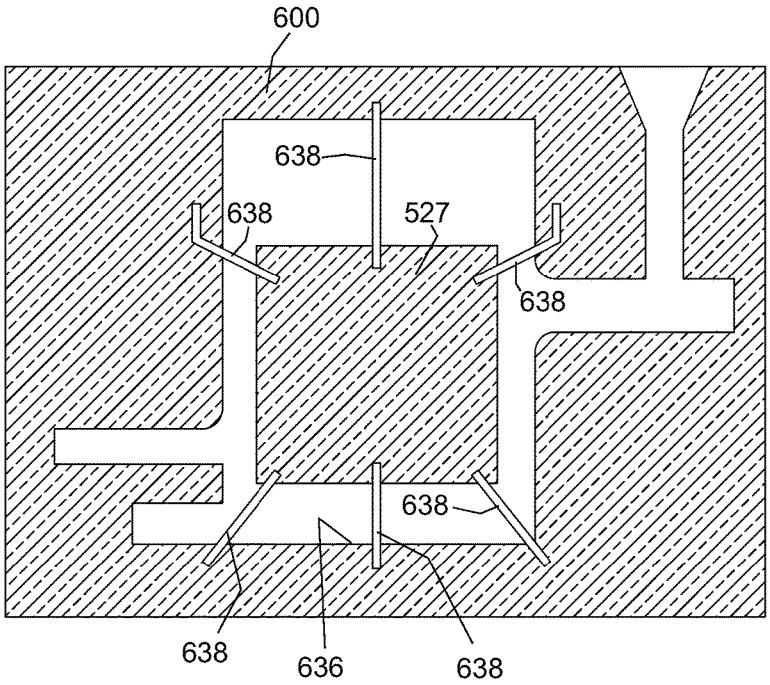
FIG. 7 is a schematic, sectional view of a mold assembly for using in casting the casing assembly of FIG. 6.

FIG. 7 shows one possible arrangement by which the casing assembly 500 may be cast. A mold 600 is provided having an internal cavity 636 which defines the outer contours of the casing assembly 500 and receives a molten alloy during the casting process. The mold 600 may be constructed from a known ceramic material as described above. The block 527 is provided as a core element, and may be suspended within the mold cavity 636, for example using platinum wires 638 that extend between the mold 600 and the block 527. The mold is used in a known fashion, by introducing molten metal alloy into the mold cavity 636 and allowing it to solidify. After the alloy solidifies, the mold 600 is removed by known methods, leaving the finished casing assembly 500 with the block 527 remaining therein.

FIGS. 8 and 9 illustrate a casing assembly 700 similar to the casing assembly 500 shown in FIG. 6 and including a forward ring 702 with a forward flange 706, an aft ring 704 with an aft flange 708, an inner ring 712 joining the inner ends of the forward and aft flanges 706, 708, and an annular outboard ring 728 surrounding the forward and aft flanges 706 and 708. All of these elements are formed as a unitary, integral, or monolithic structure, for example using known investment casting methods. The monolithic structure, excepting the inner ring 702, constitutes an annular structure referred to herein as an "outer ring" 711.

Collectively, the inner ring 712, the forward ring 702, the aft ring 704, and the outboard ring 728 define a cavity 726 disposed in axial alignment with the inner ring 712 and radially outward thereof. The cavity 726 is filled with a ring of cellular material 727 as described above, e.g. honeycomb material. The hollow cells of the cellular material are filled with a solid material 729 having a thermal conductivity significantly lower than the surrounding material, such as a ceramic. Materials such as silica, alumina- or zircon-based ceramics commonly used for coring in the investment casting process may be used. The presence of the solid material 729 serves as a conduction cut mentioned above. The cellular material 727 serves to retain the solid material in position and preserve its effectiveness even if the solid material 729 degrades. For example, if the solid material were to break up into loose powder from engine vibration, it would still remain within the cells and still be effective as a conduction cut. This filled cellular material could be used in any of the physical configurations described above and shown in FIGS. 2-6.

The casing structures described herein utilize a conduction cut between inner and outer rings, with the technical effect of reducing the temperature of the outer ring, and slowing down the casing's thermal response as compared to prior art casings. This will have the result of a better match in thermal response between the casing assembly and the rotor therein. This is expected to provide a significant advantage over prior art designs in maintaining acceptable radial clearances.

The foregoing has described a casing assembly for a gas turbine engine and a method for its manufacture. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying potential points of novelty, abstract and drawings), or to any novel one, or any novel combination, of the steps of any method or process so disclosed.

What is claimed is:

1. A casing assembly for a gas turbine engine having a centerline axis, the casing assembly comprising:

a metallic inner ring defining an annular flowpath surface which surrounds an outer end of a row of rotatable compressor blades;

a metallic outer ring positioned in axial alignment with and radially outward of the metallic inner ring, the metallic outer ring including a forward ring having a forward flange and an aft ring having an aft flange, the forward and aft flanges abutting each other and being clamped together by a plurality of fasteners; and a conduction cut disposed between the metallic inner ring and the metallic outer ring and in axial alignment with the metallic inner ring and the forward and aft flanges, and configured for a break or a step-change reduction in a thermal conductivity in a physical path for conduction heat transfer between the metallic inner ring and the metallic outer ring, and wherein the metallic inner ring includes a seal flange extending from an end thereof towards the metallic outer ring.

2. The casing assembly of claim 1 wherein the conduction cut is defined by a cavity disposed between the metallic inner ring and metallic outer ring.

3. The casing assembly of claim 2 wherein a vent is provided, connecting the cavity with a surrounding environment.

4. The casing assembly of claim 1 wherein the cavity is filled with a cellular material.

5. The casing assembly of claim 4 wherein cells of the cellular material are filled with a ceramic material having a thermal conductivity lower than a thermal conductivity of the metallic inner ring.

6. The casing assembly of claim 4 wherein the cellular material comprises a honeycomb having hexagonal cells defined by metallic walls.

7. The casing assembly of claim 6 wherein the cavity is filled with a ceramic material having a thermal conductivity lower than a thermal conductivity of the metallic inner ring.

8. The casing assembly of claim 1 wherein:

the metallic outer ring is formed by first and second rings each having a radially-aligned flange, wherein each radially-aligned flange abuts each other and are each clamped together by a mechanical fastener; and the metallic inner ring is coupled to one of the first and the second rings by an annular arm extending from a first end of the metallic inner ring.

9. The casing assembly of claim 8, wherein a resilient seal is disposed between the seal flange and the metallic outer ring.

10. The casing assembly of claim 9 wherein the resilient seal is disposed in a rabbet formed in the seal flange.

11. A method of making a casing assembly, comprising:

providing a mold comprising a ceramic material with a mold cavity therein, defining the casing assembly of claim 10;

suspending a block of ceramic material within the mold cavity;

filling the mold with molten metal alloy;

allowing the metal alloy to solidify; and removing the mold, leaving the block within the solidified metal alloy.

12. The method of claim 11 wherein the block is suspended by wires embedded in the block and the mold.

13. A compressor for a gas turbine engine, said compressor comprising:

a rotor comprising a plurality of circumferentially-spaced apart rotor blades, and a casing assembly positioned surrounding the rotor, comprising:

a metallic inner ring defining an annular flowpath surface which surrounds an outer end of a row of rotatable compressor blades;

a metallic outer ring positioned in axial alignment with and radially outward of the metallic inner ring, the metallic outer ring including a forward ring having a forward flange and an aft ring having an aft flange, the forward and aft flanges abutting each other and being clamped together by a plurality of fasteners; and a conduction cut disposed between the metallic inner ring and the metallic outer ring and in axial alignment with the metallic inner ring and the forward and aft flanges, and configured for a break or a step-change reduction in a thermal conductivity in a physical path for conduction heat transfer between the metallic inner ring and the metallic outer ring, and wherein the metallic inner ring includes a seal flange extending from an end thereof towards the metallic outer ring.

14. The compressor of claim 13 wherein the conduction cut is defined by a cavity disposed between the metallic inner ring and the metallic outer ring.

15. The compressor of claim 14 wherein the cavity is filled with a cellular material.

* * * * *